US011845287B2

(12) United States Patent
Oya

(10) Patent No.: US 11,845,287 B2
(45) Date of Patent: Dec. 19, 2023

(54) LIQUID CARTRIDGE

(71) Applicant: CANON KABUSHIKI KAISHA, Tokyo (JP)

(72) Inventor: Katsunori Oya, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 18/175,191

(22) Filed: Feb. 27, 2023

(65) Prior Publication Data

US 2023/0219346 A1 Jul. 13, 2023

Related U.S. Application Data

(62) Division of application No. 17/397,818, filed on Aug. 9, 2021, now Pat. No. 11,618,262.

(30) Foreign Application Priority Data

Sep. 23, 2020 (JP) ..... 2020-158548

(51) Int. Cl.
*B41J 2/175* (2006.01)

(52) U.S. Cl.
CPC ..... *B41J 2/17523* (2013.01); *B41J 2/1754* (2013.01); *B41J 2/17513* (2013.01); *B41J 2/17553* (2013.01); *B41J 2/17556* (2013.01)

(58) Field of Classification Search
CPC .... B41J 2/175; B41J 2/17503; B41J 2/17506; B41J 2/17509; B41J 2/17513; B41J 2/1752; B41J 2/17523; B41J 2/1754; B41J 2/17553; B41J 2/17556
See application file for complete search history.

(56) References Cited

U.S. PATENT DOCUMENTS

| | | | | |
|---|---|---|---|---|
| 10,357,976 | B2 * | 7/2019 | Ono | B41J 2/17509 |
| 11,618,262 | B2 * | 4/2023 | Oya | B41J 2/17553 347/86 |
| 2016/0279960 | A1 | 9/2016 | Okazaki et al. | B41J 2/175 |
| 2017/0279960 | A1 | 9/2017 | Zhang | H04M 3/30 |
| 2018/0272741 | A1 | 9/2018 | Kobayashi et al. | B41J 2/19 |

FOREIGN PATENT DOCUMENTS

JP 2018-161876 10/2018

* cited by examiner

*Primary Examiner* — Anh T Vo
(74) *Attorney, Agent, or Firm* — Venable LLP

(57) ABSTRACT

A liquid cartridge capable of being attached to or detached from a predetermined apparatus includes: a container which stores a liquid; a supply port which supplies the predetermined apparatus with the liquid stored in the container; an air communication hole which allows the container to communicate with the atmosphere; and a valve mechanism capable of switching between opening and blocking of the air communication hole. The valve mechanism includes a valve element which can be brought into intimate contact with the air communication hole to block the air communication hole, and a lever which moves, while rotating, between a first position in which the valve element is brought into intimate contact with the air communication hole and a second position in which the valve element is separated from the air communication hole in response to attaching/detaching of the liquid cartridge to/from the predetermined apparatus.

10 Claims, 9 Drawing Sheets

LIQUID CARTRIDGE

This application is a divisional of application Ser. No. 17/397,818 filed Aug. 9, 2021, currently pending; and claims priority under 35 U.S.C. § 119 from Japanese Patent Application No. 2020-158548 filed in Japan on Sep. 23, 2020; and the contents of all of which are incorporated herein by reference as if set forth in full.

BACKGROUND OF THE INVENTION

Field of the Invention

The present disclosure relates to a liquid cartridge.

Description of the Related Art

As in an ink cartridge used in an ink jet printing apparatus, a liquid cartridge mounted on a predetermined apparatus to be used includes a liquid reservoir which stores a liquid, a liquid supply port which supplies the apparatus with the liquid, and an air communication hole which allows the liquid reservoir to communicate with the atmosphere. Prior to mounting of the liquid cartridge on the apparatus, both the liquid supply port and the air communication hole are blocked to prevent the liquid stored in the liquid reservoir from leaking out. On the other hand, in a state in which the liquid cartridge is mounted on the apparatus, both the liquid supply port and the air communication hole are opened such that the atmosphere enters through the air communication hole in response to consumption of the liquid stored in the liquid reservoir to stably supply the apparatus with the liquid.

Japanese Patent Laid-Open No. 2018-161876 discloses a liquid cartridge including a valve element which blocks an air communication hole, a lever capable of pressing the valve element in a blocking direction, and a spring which biases the valve element in a direction that opens the air communication hole. Japanese Patent Laid-Open No. 2018-161876 discloses, as to the liquid cartridge prior to being mounted on an apparatus, a configuration in which the valve element is pressed by the lever to block the air communication hole and in mounting the liquid cartridge on the apparatus, the lever is rotated to release the press of the valve element such that the air communication hole is opened by the bias force of the spring.

SUMMARY OF THE INVENTION

In Japanese Patent Laid-Open No. 2018-161876, in removing the once-mounted liquid cartridge from the apparatus, the lever does not return to its original posture and the air communication hole remains open. Thus, in a case where the liquid cartridge is removed from the apparatus in a state in which a liquid has been halfway consumed, there is a possibility that the liquid which stays in the liquid cartridge leaks from the air communication hole or a liquid supply port. In addition, in a case where the liquid cartridge in which the liquid has been halfway consumed is left uncontrolled after removal from the apparatus, there is also a possibility that the liquid evaporates through the air communication hole to change liquid quality or that the liquid leaks out.

The present disclosure has been accomplished to solve the above-described problems. Thus, an object of the present disclosure is to provide a liquid cartridge capable of appropriately switching between blocking and opening of an air communication hole in response to attaching to/detaching from an apparatus.

For this purpose, the present disclosure is a liquid cartridge capable of being attached to or detached from a predetermined apparatus, the liquid cartridge including a container configured to store a liquid, a supply port configured to supply the predetermined apparatus with the liquid stored in the container, the air communication hole configured to allow the container to communicate with the atmosphere, and a valve mechanism capable of switching between opening and blocking of the air communication hole, wherein the valve mechanism includes a valve element configured to be brought into intimate contact with the air communication hole and capable of blocking the air communication hole, and a lever configured to move, while rotating, between a first position in which the valve element is brought into intimate contact with the air communication hole and a second position in which the valve element is separated from the air communication hole in response to attaching/detaching of the liquid cartridge to/from the predetermined apparatus.

Further features of the present invention will become apparent from the following description of exemplary embodiments with reference to the attached drawings.

DESCRIPTION OF THE EMBODIMENTS

First Embodiment

Figure 1:
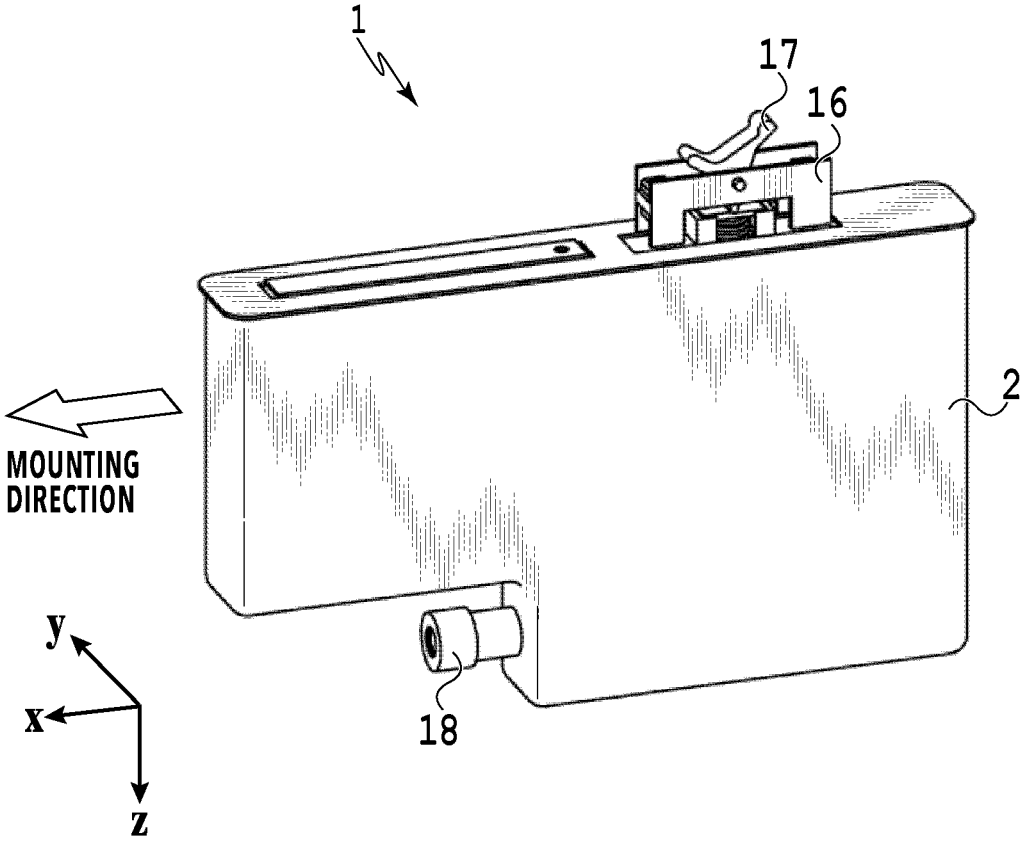
FIG. 1 is an external perspective view of an ink cartridge.

FIG. 1 is an external perspective view of an ink cartridge 1 which can be used as a liquid cartridge of the present disclosure. In the figures to be described below, an x direction indicates a mounting direction of the ink cartridge 1, a y direction indicates a width direction of the ink cartridge 1, and a z direction indicates a gravitational direction. The ink cartridge 1 includes a container 2 which stores ink, and a supply port 18 which supplies a printing apparatus (not shown) with the stored ink. Further, on the upper surface of the ink cartridge 1, a lever 17 to be engaged with the printing apparatus in mounting the ink cartridge 1 on the printing apparatus and an attachment member 16 in which the lever 17 is rotatably attached are provided.

Figure 2:
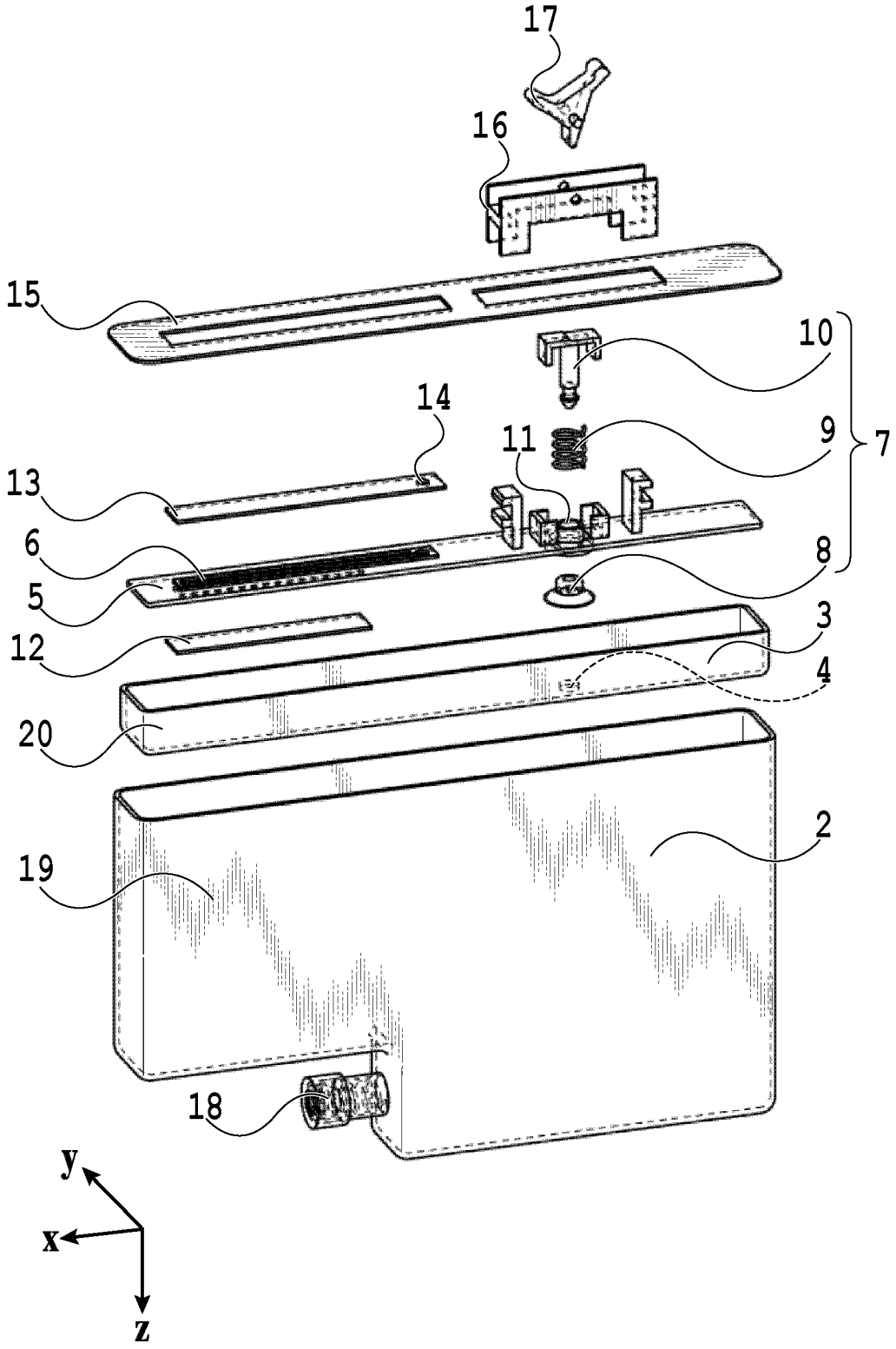
FIG. 2 is an exploded perspective view of the ink cartridge.

FIG. 2 is an exploded perspective view of the ink cartridge 1. The ink cartridge 1 is formed by stacking the container 2, a middle cover 3, and an upper cover 5 in this order and further by welding a sheet film 15 from the upper surface. The inside of the container 2 is a space for ink 19 which stores the ink and the stored ink is supplied to the printing apparatus through the supply port 18 provided below.

The middle cover 3 of boxed shape includes a space for atmosphere 20 which accommodates the atmosphere and an air communication hole 4 communicating with the space for ink 19 is formed at the bottom, which is a partition between the space for atmosphere 20 and the space for ink 19.

A bending flow channel 6 which guides the atmosphere is formed at the front-side in the x direction of the upper surface of the upper cover 5 and a penetration port (not shown) communicating with the space for atmosphere 20 is formed at the terminal of the bending flow channel 6. A film with an aperture 13 on which an aperture 14 is formed is also welded on the upper surface of the bending flow channel 6. Further, a semipermeable membrane 12 which does not allow a liquid to pass through and allows gas to pass through is bonded on the rear surface of the bending flow channel 6, that is, on the lower surface of the upper cover 5. In such a configuration, air in the atmosphere is supplied to the space for ink 19 through the aperture 14, the bending flow channel 6, the penetration port (not shown), the semipermeable membrane 12, the space for atmosphere 20, and the air communication hole 4.

On the other hand, a valve mechanism 7 which controls blocking and opening of the air communication hole 4 of the middle cover 3 is provided at the back-side in the x direction of the upper cover 5. The valve mechanism 7 has a pad 8 including a rubber member, a rod 10 to be coupled to the pad 8, and a spring member 9 which biases the rod 10 upward (−z direction). The tip of the rod 10 is caused to vertically movably pass through the spring member 9 and a rod shaft hole 11 formed in the upper cover 5 and the tip of the rod 10 is further coupled to the pad 8, whereby the valve mechanism 7 is formed.

The sheet film 15 is welded from the upper surface in a state in which the middle cover 3 and the upper cover 5 are stacked on an aperture of the container 2. Further, the attachment member 16 in which the lever 17 is rotatably attached is arranged on the valve mechanism 7 via an aperture of the sheet film 15, thereby forming the ink cartridge 1.

Figure 3:
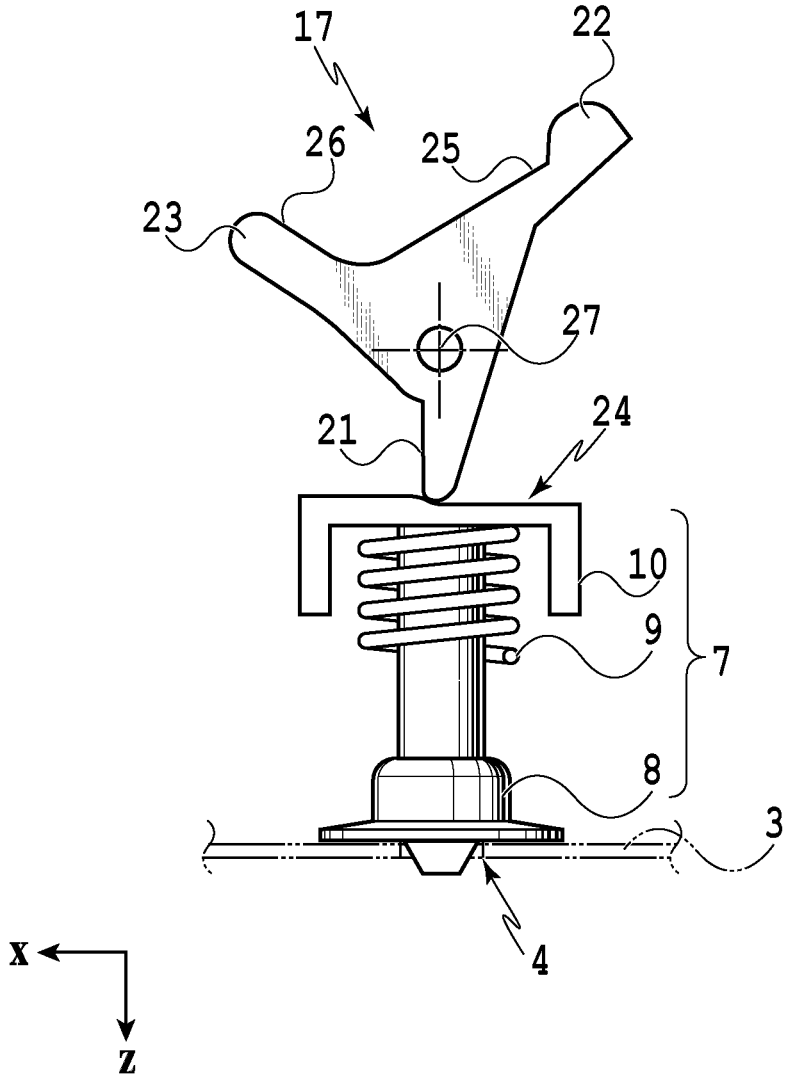
FIG. 3 is an enlarged view showing a configuration of a valve mechanism and a lever.

FIG. 3 is an enlarged view showing a configuration of the valve mechanism 7 and the lever 17. The lever 17 has three protrusions including a first protrusion 21, a second protrusion 22, and a third protrusion 23 and is capable of rotating around a rotating shaft 27.

The first protrusion 21 is a protrusion which abuts on the valve mechanism 7 for action. The second protrusion 22 is a protrusion which receives external forces in mounting the ink cartridge 1 on the printing apparatus and has a second abutting surface 25 which abuts on a cartridge case (not shown in FIG. 3) of the printing apparatus. The third protrusion 23 is a protrusion which receives the external forces in removing the ink cartridge 1 from the printing apparatus and has a third abutting surface 26 which abuts on the cartridge case (not shown in FIG. 3) of the printing apparatus.

FIG. 3 shows a state in which the first protrusion 21 abuts on a first abutting surface 24 on the rod 10 of the valve mechanism 7, and presses the rod 10 downward against the bias force of the spring member 9 such that the pad 8 serving as a valve element blocks the air communication hole 4. Such a state corresponds to a state in a case where the ink cartridge 1 is not mounted on the printing apparatus. Incidentally, the first abutting surface 24 on which the first protrusion 21 abuts is provided at the back-side in the x direction, which is the mounting direction, on the top surface of the rod 10 and is formed one step lower than a surface at the front-side. Providing such a step can suppress rotation of the first protrusion 21 past the step and floating of the pad 8.

Figure 4:
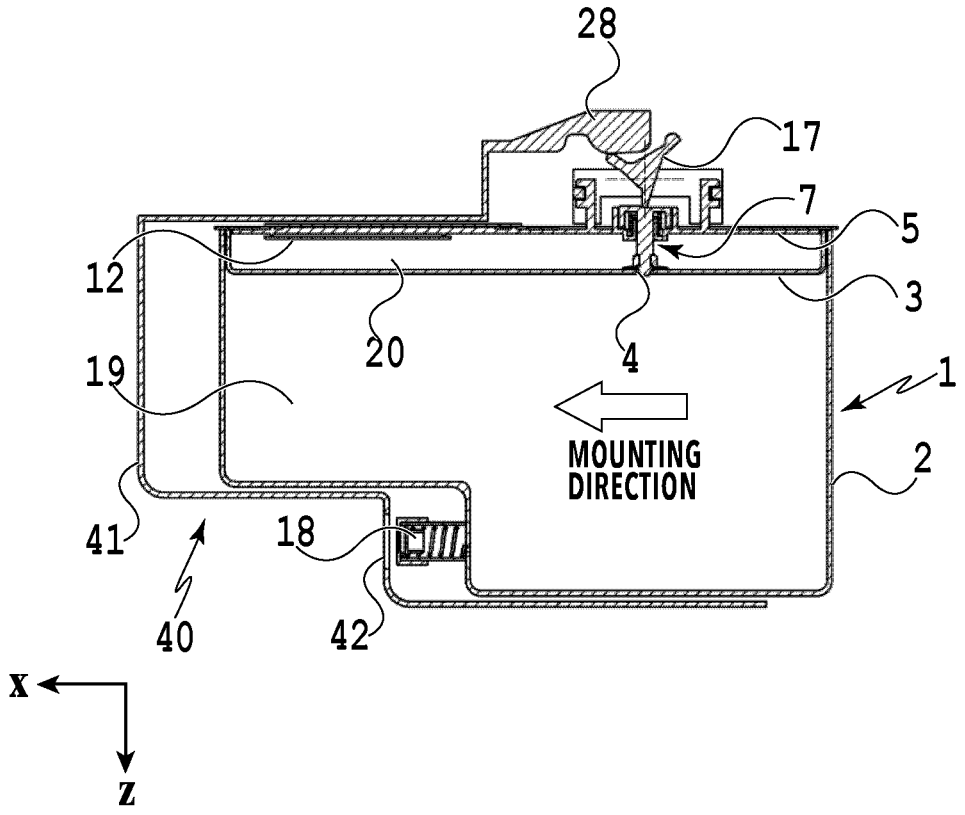
FIG. 4 is a diagram showing a state in which the ink cartridge is being mounted on a cartridge case.

FIG. 4 is a diagram showing a state in which the ink cartridge 1 is being mounted on a cartridge case 40 provided in the printing apparatus. The cartridge case 40 includes a case 41 which retains the entire ink cartridge 1, a penetration port 42 which allows the supply port 18 of the ink cartridge 1 to penetrate, and an engaging portion 28 which is an abutting member for the lever 17 and is engageable with the lever 17.

Figure 5:
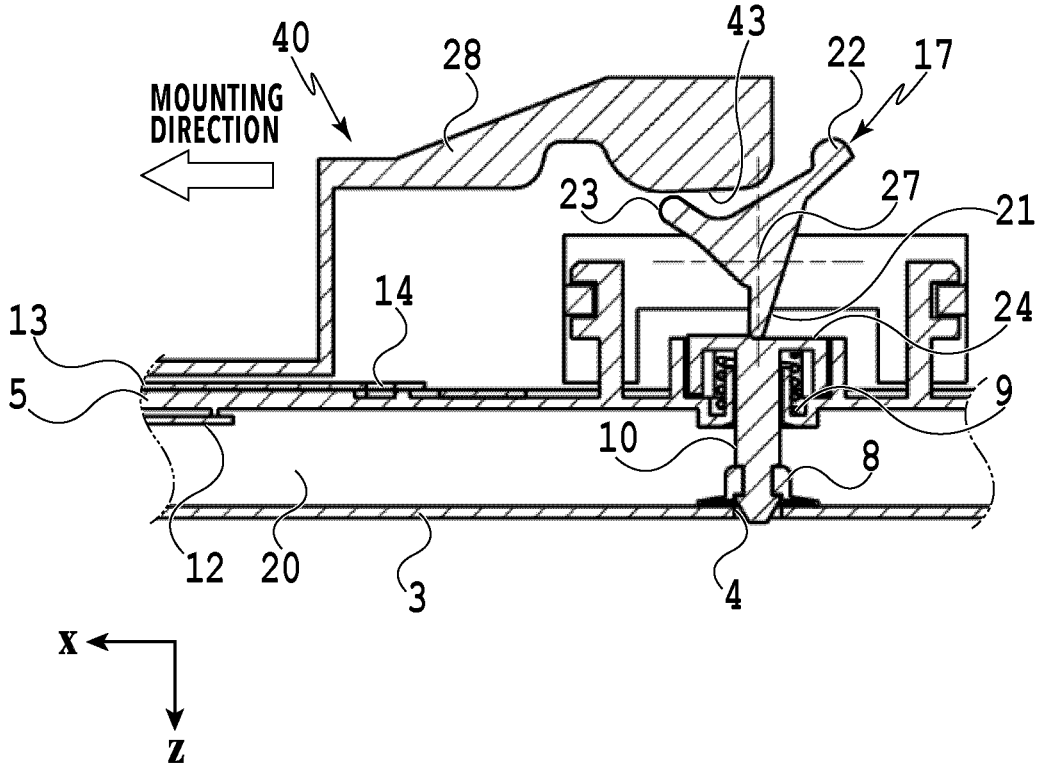
FIG. 5 is an enlarged view of the lever while the ink cartridge is being on the cartridge case.

FIG. 5 is an enlarged view showing a state of the lever 17 while the ink cartridge 1 is being mounted on the cartridge case 40. In FIG. 5, a state is shown in which the third protrusion 23 of the lever 17 has already entered the inside of the cartridge case 40 and the second protrusion 22 has not entered the cartridge case 40 yet. Since the third protrusion 23 is situated at a position lower than a lower surface 43 of the engaging portion 28, the lever 17 does not abut on the engaging portion 28. The first protrusion 21 abuts on the first abutting surface 24 and presses the rod 10 downward against the bias force of the spring member 9. The pad 8 attached at the tip of the rod 10 is in intimate contact with the air communication hole 4 to block this hole. The spring member 9 is compressed between the rod 10 and the upper cover 5. In the state shown in FIG. 5, in a case where the ink cartridge 1 is further inserted in the x direction, the second protrusion 22 of the lever 17 abuts on the engaging portion 28 and the lever 17 rotates clockwise in the figure.

Figure 6A:
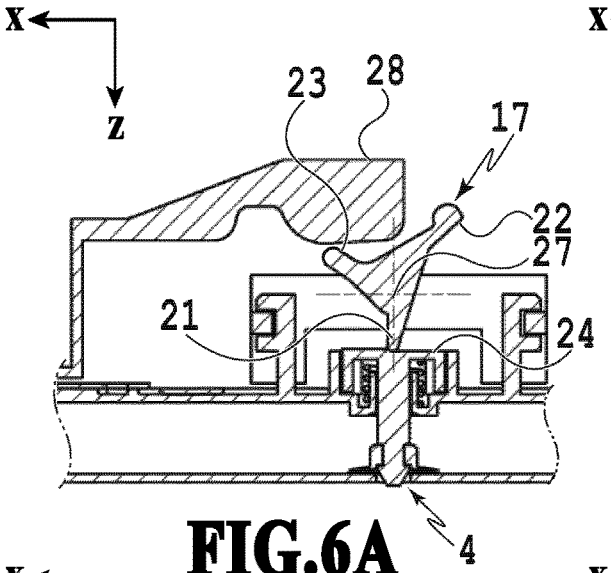
FIGS. 6A to 6F are transition diagrams of the lever while the ink cartridge is being mounted on the cartridge case.

FIGS. 6A to 6F are transition diagrams showing the rotating positions of the lever 17 and the states of the valve mechanism 7 in the process of mounting of the ink cartridge 1 on the cartridge case 40. Similarly to FIG. 5, FIG. 6A shows a state in which the third protrusion 23 of the lever 17 has entered the inside of the cartridge case 40 and the second protrusion 22 has not entered the cartridge case 40.

Figure 6D:
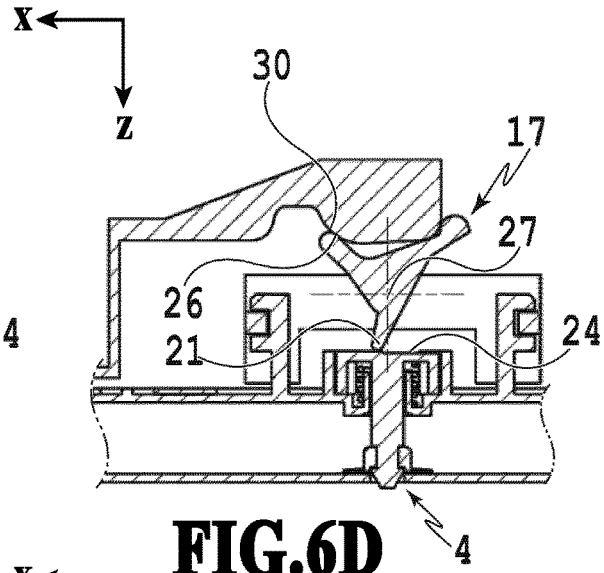
Figure 6B:
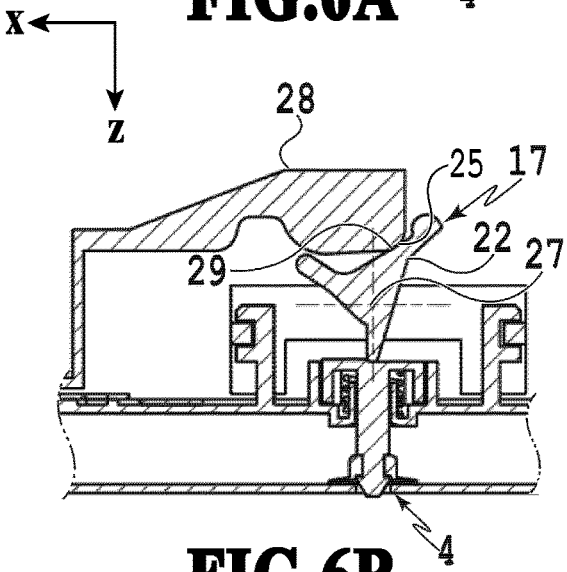

FIG. 6B shows a state in which the ink cartridge 1 further enters the cartridge case 40 from the state shown in FIG. 6A and the second protrusion 22 abuts on the engaging portion 28 of the cartridge case 40. A corner portion 29 of the engaging portion 28 abuts on the second abutting surface 25 of the second protrusion 22, whereby the lever 17 start to rotate in a clockwise direction.

Figure 6E:
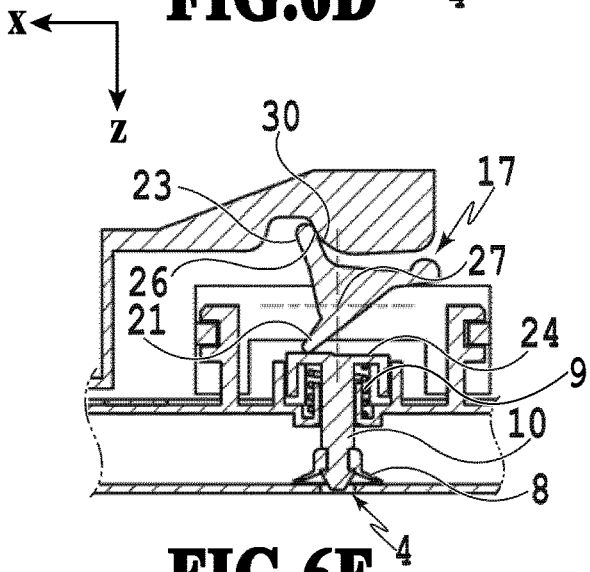
Figure 6C:
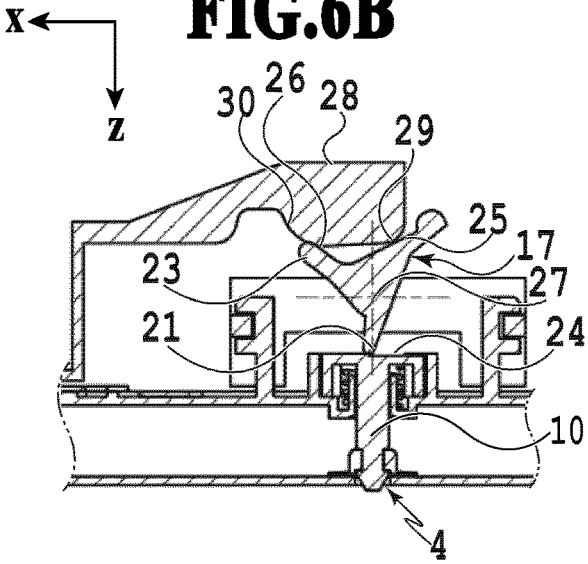

FIG. 6C shows a state in which the ink cartridge 1 further enters the cartridge case 40 from the state shown in FIG. 6B. The lever 17 rotates around the rotating shaft 27 in the clockwise direction and the first protrusion 21 deviates to the left direction past the step on the top surface of the rod 10 and is situated away from the first abutting surface 24. On the other hand, in response to the rotation of the lever 17, the third abutting surface 26 of the third protrusion 23 comes to abut on a lever abutting recess 30 of the engaging portion 28.

FIG. 6D shows a state in which the ink cartridge 1 further enters the cartridge case 40 from the state shown in FIG. 6C. The lever 17 further rotates and the abutting position of the first protrusion 21 deviates further to the left direction.

FIG. 6E shows a state in which the ink cartridge 1 further enters the cartridge case 40 from the state shown in FIG. 6D. By the first protrusion 21 deviating from the first abutting surface 24, the force pressing the rod 10 downward decreases to move the rod 10 and the pad 8 upward by the bias force of the spring member 9. The third protrusion 23 enters the lever abutting recess 30 while causing the third abutting surface 26 to abut on the lever abutting recess 30.

Figure 6F:
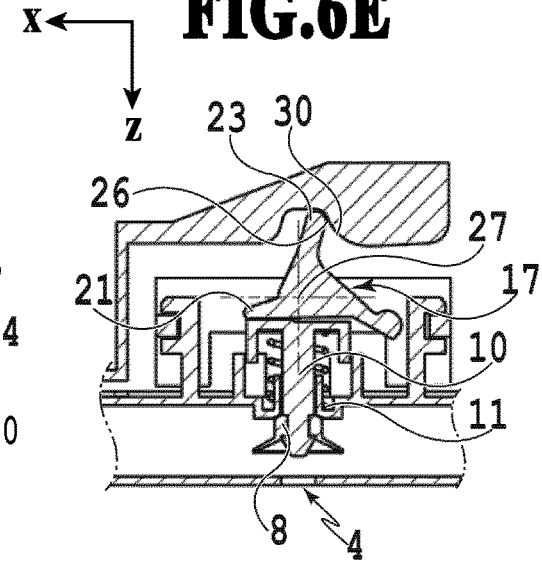

FIG. 6F shows a state in which the ink cartridge 1 further enters the cartridge case 40 from the state shown in FIG. 6E. The first protrusion 21 deviates from the first abutting surface 24, the rod 10 moves further upward by release of the force pressing the rod 10 downward, and the pad 8 is separated from the air communication hole 4 to open the air communication hole 4. The third protrusion 23 deeply enters the lever abutting recess 30. With the state shown in FIG. 6F, the mounting of the ink cartridge 1 on the printing apparatus is completed.

Figure 7:
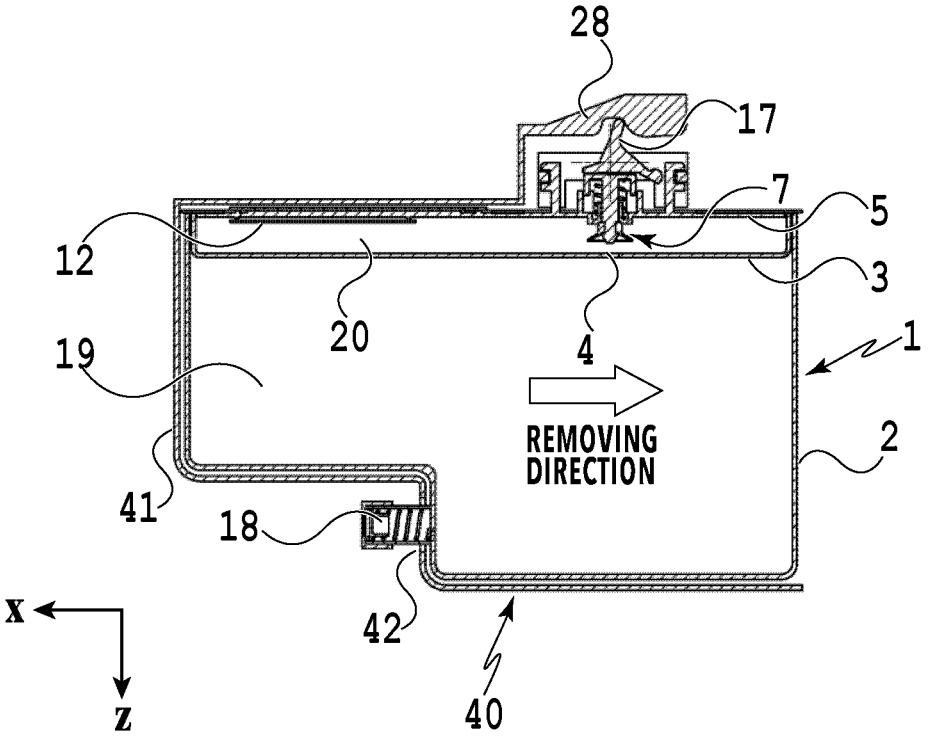
FIG. 7 is a diagram showing a state in which the ink cartridge is mounted on the cartridge case.

FIG. 7 is a diagram showing a state in which the ink cartridge 1 is mounted on the cartridge case 40 of the printing apparatus. Almost all of the ink cartridge 1 is accommodated in the case 41 of the cartridge case 40 and the supply port 18 penetrates the penetration port 42.

Figure 8:
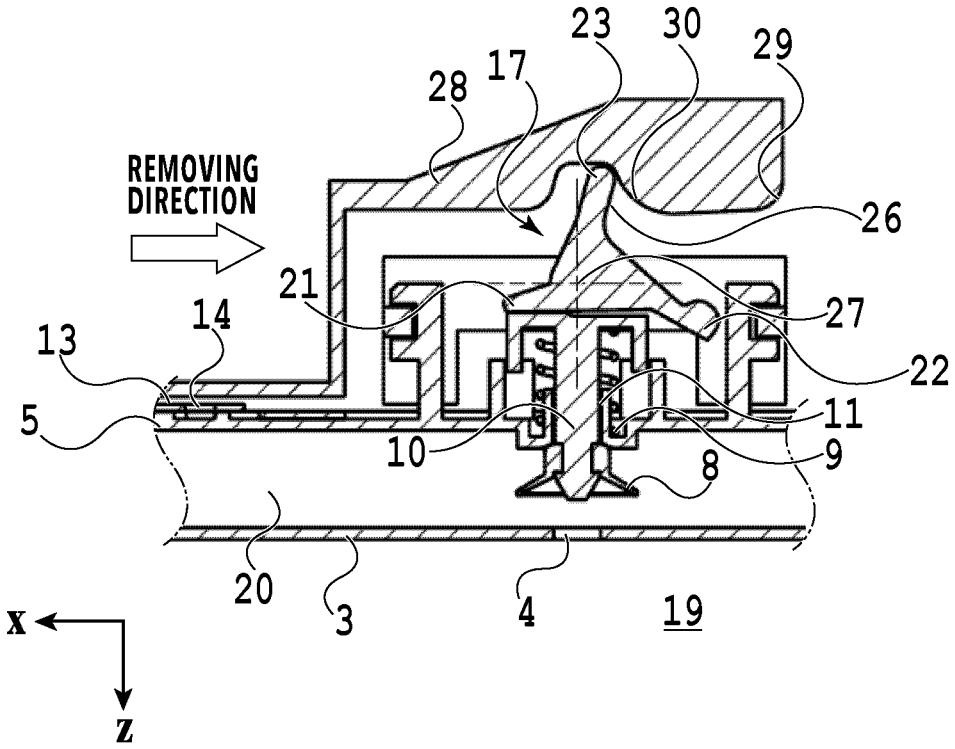
FIG. 8 is an enlarged view of the lever in a state in which the ink cartridge is mounted on the cartridge case.

FIG. 8 is an enlarged view showing an abutment state of the lever 17 and the engaging portion 28 in a state in which the ink cartridge 1 is mounted on the cartridge case 40. With respect to the state before mounting of the ink cartridge 1 on the cartridge case 40 described with reference to FIG. 5, in FIG. 8, the lever 17 rotates in the clockwise direction such that the third protrusion 23 is engaged with the lever abutting recess 30 of the engaging portion 28. By the bias force of the spring member 9, the rod 10 and the pad 8 move upward to fully open the air communication hole 4. In such a state, the air accommodated in the space for atmosphere 20 via the aperture 14 can enter the space for ink 19 through the air communication hole 4. In other words, even in a case where the ink stored in the space for ink 19 is consumed, the internal pressure of the space for ink 19 is maintained at the same pressure as the atmospheric pressure and this makes it possible to stably supply the printing apparatus with the ink stored in the space for ink 19. On the other hand, by the bias force of the spring member 9, the pad 8 abuts on the rod shaft hole 11, which can prevent the ink from leaking through a gap between the rod shaft hole 11 and the rod 10.

In removing the ink cartridge 1 from the printing apparatus, a state of the lever 17 and the valve mechanism 7 transitions in order opposite to the order described with reference to FIGS. 6A to 6F. That is, in a case where a user pulls the cartridge case 40 in a −x direction, the third protrusion 23 receives drag from the lever abutting recess 30, whereby the lever 17 rotates in a counterclockwise direction opposite to the direction in mounting the ink cartridge 1 on the cartridge case 40. The first protrusion 21 then gradually presses down the rod 10 and the pad 8 against the bias force of the spring member 9 so as to eventually return to the state shown in FIGS. 5 and 6A, that is, a state in which the first protrusion 21 presses the first abutting surface 24 such that the pad 8 blocks the air communication hole 4. At that time, it is preferable that the lever abutting recess 30 of the engaging portion 28 be curve-shaped such that the lever 17 can smoothly pass in the −x direction along the lever abutting recess 30 while surely pressing down the rod 10. In the present embodiment, the engaging portion 28 is provided with the lever abutting recess 30 and the lever 17 is provided with the third protrusion 23 which fits into the lever abutting recess 30, thereby blocking the air communication hole 4 in removing the ink cartridge from the printing apparatus. This makes it possible to appropriately switch between blocking and opening of the air communication hole 4 in response to attaching to/detaching of the ink cartridge from the printing apparatus.

As described above, in the present embodiment, in a case where the ink cartridge 1 is not mounted on the printing apparatus, the lever 17 is in a first position as shown in FIG. 5. That is, the first protrusion 21 presses down the rod 10 and the pad 8 against the bias force of the spring member 9 to block the air communication hole 4.

In a case where the ink cartridge 1 is mounted on the printing apparatus, the lever 17 rotates in the clockwise direction from the first position shown in FIG. 5 to the second position shown in FIG. 8 by the second protrusion 22 abutting on the engaging portion 28. The rod 10 and the pad 8 suppressed by the first protrusion 21 then rise by the bias force of the spring member 9 to open the air communication hole 4.

On the other hand, in a case where the ink cartridge 1 is removed from the printing apparatus, the lever 17 rotates in the counterclockwise direction from the second position shown in FIG. 8 to the first position shown in FIG. 5 by the third protrusion 23 abutting on the engaging portion 28. The first protrusion 21 then presses down the rod 10 and the pad 8 against the bias force of the spring member 9 to block the air communication hole 4.

After that, also in a case where the same ink cartridge 1 is again mounted on or removed from the printing apparatus, the lever 17 rotates in a reciprocating manner between the first and second positions in the same steps as the steps described above to switch between opening and blocking of the air communication hole 4 according to a rotation position thereof. Thus, in a state in which the ink cartridge 1 is mounted, it is possible to suitably use the ink cartridge 1 regardless of the frequency of attaching/detaching of the ink cartridge 1.

Although the embodiment in which the first protrusion 21 of the lever 17 abuts on the first abutting surface 24 which is a lower side of the step formed on the top surface of the rod 10 has been described above, the shapes of the first protrusion 21 and the first abutting surface 24 may further be adjusted for smooth operation of the attaching/detaching.

Figure 9:
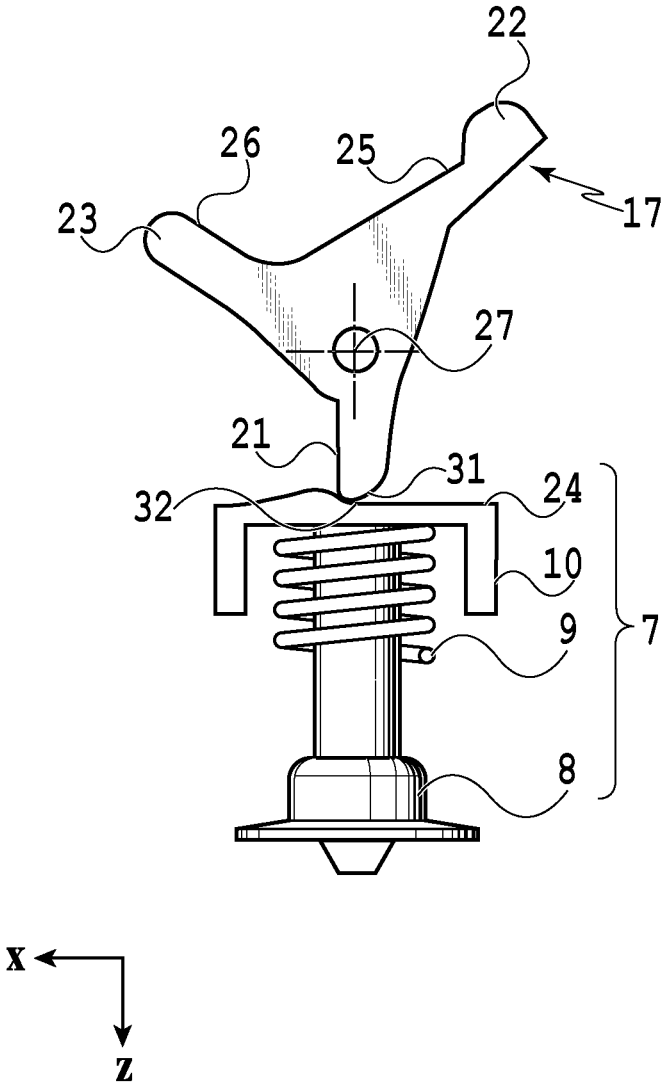
FIG. 9 is a diagram showing a modification example of the configuration of the valve mechanism and the lever.

FIG. 9 is a diagram showing a modification example of the shapes of the first protrusion 21 and the first abutting surface 24. In the present modification example, a first curve 31 is formed at the right of the first protrusion 21 and a second curve 32 which fits the first curve 31 is formed on the first abutting surface 24. Causing the first protrusion 21 and the first abutting surface 24 to have these shapes smooths abutment or rubbing of the first protrusion 21 and the rod 10 at the time of the rotation of the lever 17 and enables even smoother operation of the attaching/detaching of the ink cartridge 1.

Further, although the embodiment in which the ink cartridge 1 is mounted in a horizontal direction on the cartridge case 40 of the printing apparatus has been described above, the mounting direction or a mounting posture may be inclined to some extent with respect to the horizontal direction. Provided that the liquid stored in the space for ink 19 can be appropriately supplied to the printing apparatus through the supply port 18 and the external atmosphere can appropriately flow into the space for ink 19 through the air communication hole 4, the shapes or postures of the ink cartridge 1 and the valve mechanism may be changed as appropriate.

Furthermore, although an ink cartridge which can be mounted on an ink jet printing apparatus has been described as the liquid cartridge of the present disclosure above, the configurations of the ink cartridge described above may naturally be applied to various embodiments. Provided that a cartridge accommodating liquid is used while being detachably mounted on some apparatus, the configurations of the embodiment described above can function effectively regardless of a usage purpose for the liquid.

According to the present disclosure, it is possible to provide the liquid cartridge capable of appropriately switching between blocking and opening of the air communication hole in response to attaching to/detaching from the apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-158548, filed Sep. 23, 2020, which is hereby incorporated by reference wherein in its entirety.

What is claimed is:

1. A the liquid cartridge comprising:

a container configured to store a liquid;

a supply port configured to supply the liquid stored in the container to outside of the container;

an air communication hole configured to allow the container to communicate with atmosphere; and a valve mechanism capable of switching between opening and blocking of the air communication hole, wherein the valve mechanism comprises a valve element capable to be brought into intimate contact with the air communication hole to block the air communication hole, and a lever configured to rotate in a reciprocating manner, between a first position in which the valve element is brought into intimate contact with the air communication hole and a second position in which the valve element is separated from the air communication hole, wherein the lever is provided with a first protrusion for bringing the valve element into intimate contact with the air communication hole, a secondprotrusion for rotating the lever in a first direction from the first position to the second position, and a third protrusion for rotating the lever in a second direction opposite to the first direction from the second position to the first position.

2. The liquid cartridge according to claim 1, wherein the valve mechanism further comprises:

a rod coupled to the valve element and configured to vertically move in response to rotation of the lever; and a spring member configured to bias the rod in a direction which separates the valve element from the air communication hole, wherein in a state in which the lever is in the first position, the first protrusion presses the rod against bias force of the spring member, whereby the valve element is brought into intimate contact with the air communication hole, in a state in which the liquid cartridge is being mounted on an apparatus, as the lever rotates in the first direction, the pressure by the first protrusion is released and the valve element is separated from the air communication hole, in a state in which the liquid cartridge is being removed from the apparatus, as the lever rotates in the second direction, the first protrusion presses the rod against the bias force of the spring member to bring the valve element into intimate contact with the air communication hole.

3. The liquid cartridge according to claim 2, wherein in a state in which the liquid cartridge is mounted on the apparatus, the third protrusion engages with a recess of an abutting member, and in a state in which the liquid cartridge is being removed from the apparatus, the third protrusion rotates while moving along the recess.

4. The liquid cartridge according to claim 3, wherein a first curve is formed on the third protrusion and a second curve which fits the first curve is formed on the recess and in a state in which the liquid cartridge is being removed from the apparatus, the first curve of the third protrusion moves along the second curve of the recess.

5. The liquid cartridge according to claim 2, wherein a step configured to control movement of the first protrusion is formed on an abutting surface of the rod which abuts on the first protrusion.

6. The liquid cartridge according to claim 2 further comprising a space for atmosphere configured to accommodate the atmosphere, wherein the air communication hole is formed in a partition between the space for atmosphere and the container.

7. The liquid cartridge according to claim 6, wherein the valve element and the rod are vertically movable in the space for atmosphere, and in a state in which the lever is in the second position, the valve element blocks a rod shaft hole which the rod penetrates in the space for atmosphere.

8. The liquid cartridge according to claim 1, wherein the lever is configured to rotate between the first position and the second position in response to attaching/detaching of the liquid cartridge to/from an apparatus, and the attaching/detaching of the liquid cartridge to/from the apparatus is performed in a horizontal direction.

9. The liquid cartridge according to claim 1, wherein the supply port is configured to supply the liquid stored in the container to a printing apparatus and the liquid is ink used in the printing apparatus.

10. The liquid cartridge according to claim 1, wherein the first protrusion is for bringing the valve element into intimate contact with the air communication hole in a state in which the liquid cartridge is not mounted on an apparatus, the second protrusion is for abutting on an abutting member of the apparatus to rotate the lever in a first direction from the first position to the second position in a state in which the liquid cartridge is being mounted on the apparatus, and the third protrusion is for abutting on the abutting member of the apparatus to rotate the lever in a second direction opposite to the first direction from the second position to the first position in a state in which the liquid cartridge is being removed from the apparatus.

* * * * *